United States Patent [19]

Seiller

[11] 4,231,380

[45] Nov. 4, 1980

[54] CLASP FASTENER

[76] Inventor: Pierre F. X. Seiller, Proulieu-Lagnieu (Ain), France

[21] Appl. No.: 896,392

[22] Filed: Apr. 14, 1978

[30] Foreign Application Priority Data

Apr. 15, 1977 [FR] France ..... 77 11970

[51] Int. Cl.[3] ..... A45D 8/00

[52] U.S. Cl. ..... 132/47

[58] Field of Search ..... 132/47, 46, 48 R

[56] References Cited

U.S. PATENT DOCUMENTS 1,654,560 1/1928 Storling ..... 132/48 R 3,595,249 7/1971 Solomon ..... 132/48 R

FOREIGN PATENT DOCUMENTS 640078 7/1928 France ..... 132/48 R

*Primary Examiner*—G. E. McNeill

*Attorney, Agent, or Firm*—Karl F. Ross

[57] ABSTRACT

A clasp fastener of a barrette or other article of adornment in which a wire clip is hinged to a support, comprises a ball-shaped head formed with a base in one piece and anchored in the base by molding or the like. The legs of the clip are spread upon being thrust over the ball and lock around the neck of the latter.

1 Claim, 3 Drawing Figures

CLASP FASTENER

FIELD OF THE INVENTION

The present invention relates to a locking device for a clip of a barrette, hair retainer or other article of personal adornment or the like and, more particularly, to a ball retainer for the spreadable wire clip of any structure having a base upon which the clip member is hingedly mounted.

BACKGROUND OF THE INVENTION

Hair clips or barrettes are customarily provided with an esthetically pleasing base structure which is exposed to the observer and may have an esthetically pleasing pattern, design, coloration or the like. Such base elements are frequently molded from synthetic resin material and are formed at one end, on the reverse or unexposed side, with a hinge to which a wire clip member is secured, the free end of this member comprising a pair of spreadable wire shanks or legs which are thrust over a retaining body secured to the reverse side of the base at the other end thereof. The inherent resiliency of the clip member causes the two legs to straddle this retainer until the user draws the clip member over the retainer in the opposite direction to release the barrette.

The clip member is thus constituted as an arm hinged at one end and formed from a spring metal wire which is closed to form a complete but elongated loop. In other words, the ends of the wire are bent to form the pintle of the hinge while the bight of the wire remote from the hinge connects a pair of shanks or legs which can be forced over the retainer to straddle a neck thereof.

The retainer which holds the arm in its closed position can be a locking ball or bulbous member fixed to the body or base of the barrette and projecting from the rear surface thereof so that the legs of the arm can be forced over the large portion or head of this member to ultimately straddle the neck. Traditionally, this type of retainer has been made by die-stamping or swaging a metal piece of limited thickness. The head is thus formed as a hollow member with a central cavity and associated openings.

This method of fabricating the retaining member is not compatible with modern automatic feed processes for machines adapted to produce barrettes and the like by mass production modes of operation. For example, such hollow sheet metal structures tend to jam in the feed slides because of the penetration of a part of one retainer into a opening in the other. Finally, in this connection, mention must be made of the fact that die-stamping techniques of the type hitherto used for producing such small elements has not been able to fabricate them with the desired degree of precision or accuracy, i.e. with very precise dimensions. Such precision is desired where the retaining member must be very small for fine products.

OBJECTS OF THE INVENTION

It is the principal object of the present invention to provide a retainer for a barrette or other structure of the type described which avoids the disadvantages of the earlier device of this type.

Still another object of the invention is to provide a clip closure or latching assembly for barrettes and the like which can be made with high dimensional precision.

Still another object of the invention is to provide an improved method of making a barrette.

SUMMARY OF THE INVENTION

These objects and other which will become apparent hereinafter are attained, in accordance with the present invention in a retainer for engagement by the wire clip of a barrette or the like in which the retainer comprises a base adapted to be embedded in the structure onto which it is to be mounted and which forms a unitarily one-piece body of a metal or an alloy with the ball or bulb and the neck. The locking element is produced by turning, injection molding, die-casting or the like.

The retainer, being solid, is free from openings, cavities, projections and the like so that it is able to be fed automatically by machine without any difficulty. Furthermore, the aforementioned modes of manufacture ensure that the structure will have precise dimensions.

According to a particular embodiment of the invention, the base of the retainer is of square configuration which prevents its rolling and facilitates its engagement and handling with manual mounting. Furthermore, the square base enables it to be guided with precision to the point at which it is to be embedded in the structure.

Advantageously, the base is formed with a central tip of its face opposite the head so that the base has no tendency to slide on the body of the barrette, usually formed of a synthetic-resin material, during the implantation of the retainer in this body.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
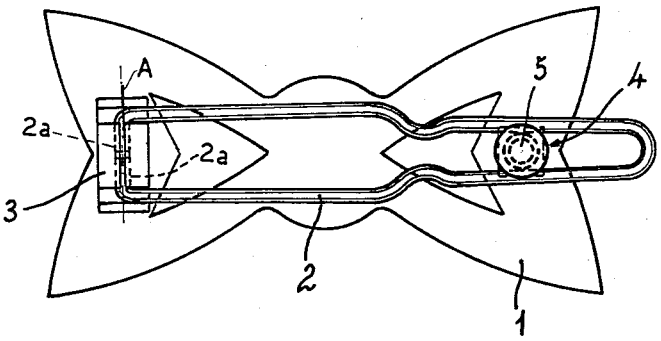
FIG. 1 is a rear elevational view of a hair barrette or clip provided with a latching system according to the present invention.
Figure 2:
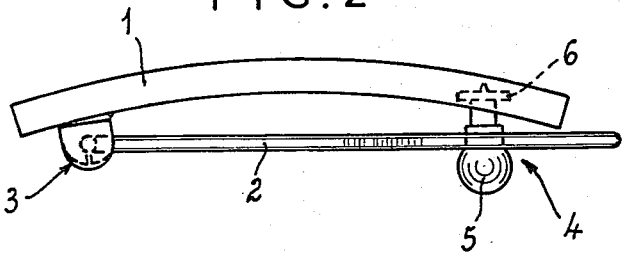
FIG. 2 is a side elevational view of the barrette in its closed condition.

FIGS. 1 and 2 show the overall construction of a hair clip or barrette in accordance with the present invention and, apart from the construction of the retaining member, of known type. This barrette comprises a principal element or body 1 of synthetic-resin material and of a esthetically pleasing configuration or color here shown to be the configuration of a body. The body 1 is concave inwardly (see FIG. 2) with the bend being spanned by the clip member 2 or arm. The latter constitutes the element which is thrust beneath the hair to secure the barrette in place.

The arm 2 is swingably mounted on the body 1 by means of a hinge 3 and, more particularly, has inwardly bent feet which form the pintle of the hinge 3. The hinge 3 is anchored to one end of the body 1 on the reverse or concave side thereof.

The arm 2 is formed by a spring metal wire of hairpin shape as shown and thus has a certain elasticity which permits the free end to be thrust over a retaining member 4 affixed to the element 1 at its end opposite that which is provided with the hinge 3.

In the region of the hinge 3 the two extremities or legs of the arm 2 are bent substantially at right angles to form the aforementioned feet 2*a* which defines the pivot axis A of the hinge.

Figure 3:
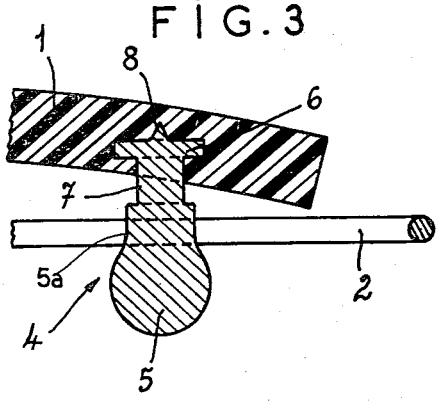
FIG. 3 is a partial cross-sectional view drawn to an enlarged scale of the barrette.

The present invention is concerned particularly with the configuration of the retaining member 4 best shown in FIG. 3.

The retaining member 4 comprises a ball-shaped head 5, which also may be termed a bulb, i.e. a pear-shaped form so that a neck 5*a* is formed inwardly of the ball 5 and is connected by a cylindrical shank 7 to a base 6 extending perpendicular to the axis of the retaining member 4. The generally planar base 6 has a square configuration and is formed on its face opposite the shank 7 with a central tip or thorn 8 whose purpose has been described previously. The entire structure 5, 5*a*, 6, 7, 8 is formed unitarily, i.e. in a monoblock, from solid metal or a die-casting alloy such as Zamac.

The retaining member 4 is adapted to be set in a hot state in the body 1 of the barrette which is composed of thermoplastic materials so that the base 6 is embedded in the element 1, the tip 8 assuring precise positioning of the member 4 until it has been anchored in place. In its perpendicular position (see FIG. 3) the neck 5*a* of the ball 5 can be straddled by the legs of the arm 2.

While the system has been described in terms of a barrette or hair clip it will be understood that it is not limited thereto except as otherwise claimed, and may be used wherever retaining balls are straddled by spring clip members.

The hinge can be of the type described in my concurrently filed copending application Ser. No. 896,393.

I claim:

1. A hair clip or the like comprising:

an elongated body of synthetic-resin material having an obverse side and a reverse side;

a hinge mounted on said reverse side of said body at one end thereof;

a bent-wire arm swingably mounted at one end on said hinge and having a free end formed with a pair of legs resiliently deflectable outwardly; and a retaining member anchored in said body on said reverse side thereof at an end of the body remote from said hinge, said retaining member comprising:

a base embedded in said body and having a square planar configuration, and a head formed on one side of said base and lying outside said body for engagement between the legs of said arm, said head and said base being solid unitarily formed of a metallic material by turning or molding, said head being generally pear-shaped and being connected by a cylindrical shank to said base, said base being formed on its side turned away from said shank with a central point adapted to position the retaining member on said body, said shank being solid and formed unitarily with said head, said base and said point.

* * * * *